US012442064B2

(12) United States Patent
Needham et al.

(10) Patent No.: US 12,442,064 B2
(45) Date of Patent: Oct. 14, 2025

(54) METHOD OF FORMING PRECURSOR INTO A Ti ALLOY ARTICLE

(71) Applicant: BAE Systems plc, London (GB)

(72) Inventors: Paul Michael Needham, Balderstone (GB); Simon Scott, Balderstone (GB)

(73) Assignee: BAE Systems plc, London (GB)

( * ) Notice: Subject to any disclaimer, the term of this patent is extended or adjusted under 35 U.S.C. 154(b) by 582 days.

(21) Appl. No.: 17/802,031

(22) PCT Filed: Mar. 11, 2021

(86) PCT No.: PCT/GB2021/050608
§ 371 (c)(1),
(2) Date: Aug. 24, 2022

(87) PCT Pub. No.: WO2021/181101
PCT Pub. Date: Sep. 16, 2021

(65) Prior Publication Data

US 2023/0106504 A1 Apr. 6, 2023

(30) Foreign Application Priority Data

Mar. 11, 2020 (EP) ..... 20275056
Mar. 11, 2020 (GB) ..... 2003495

(51) Int. Cl.
*C22F 1/18* (2006.01)
*C22C 14/00* (2006.01)

(52) U.S. Cl.
CPC ..... *C22F 1/183* (2013.01); *C22C 14/00* (2013.01)

(58) Field of Classification Search
CPC ..... C22F 1/183; C22C 14/00; B21J 5/008
See application file for complete search history.

(56) References Cited

U.S. PATENT DOCUMENTS 5,906,692 A 5/1999 Bhowal
2011/0180188 A1* 7/2011 Bryan ..... C22F 1/183 148/670

(Continued)

FOREIGN PATENT DOCUMENTS

AU 2015271901 A1 1/2016
CN 109079072 A 12/2018

(Continued)

OTHER PUBLICATIONS

Extended European Search Report for Patent Appl. No. EP20275056.8 mail date Jul. 16, 2020, 8 pages.

(Continued)

*Primary Examiner* — John A Hevey
(74) *Attorney, Agent, or Firm* — Maine Cernota & Curran

(57) ABSTRACT

A method of thermomechanically forming, for example forging, rolling, extruding or drawing, an article from a precursor thereof, is described. The method comprises: providing the precursor, for example an ingot, a forging stock, a forging, a bar, a billet or a plate, comprising, substantially comprising, essentially comprising and/or consisting of an α+β Ti alloy having a beta transus temperature $\beta_{transus}$, wherein the precursor defines a set of portions including a first portion; and thermomechanically forming the article from the precursor by heating the first portion and deforming the heated first portion by a total true strain $\varepsilon_{1,\,total}$, wherein the total true strain $\varepsilon_{1,\,total}$ is greater than a predetermined threshold true strain $\varepsilon_{threshold}$; wherein thermomechanically forming the article from the precursor comprises i iterations of: (a) heating the first portion to a temperature $T_i$ during a time $t_i$ wherein the temperature $T_i$ is at most the beta transus temperature $\beta_{transus}$; (b) deforming the heated first portion by a true strain $\varepsilon_{1,i}$, wherein the true strain $\varepsilon_{1,i}$ is at most the predetermined threshold true strain $\varepsilon_{threshold}$ and (c) repeating steps (a) and (b) until the cumu- (Continued)

lative true strain $\varepsilon_{1,\ cumulative}=\Sigma_{i\varepsilon 1,i}$eu is the total true strain $\varepsilon_{1,\ total}$ wherein i is a natural number greater than or equal to 2.

17 Claims, 5 Drawing Sheets

(56) References Cited

U.S. PATENT DOCUMENTS

| | | | | |
|---|---|---|---|---|
| 2012/0060981 | A1 | 3/2012 | Forbes Jones | |
| 2014/0076471 | A1* | 3/2014 | Forbes Jones | C22C 14/00 148/670 |
| 2014/0260492 | A1 | 9/2014 | Thomas | |
| 2015/0024871 | A1* | 1/2015 | Kawakami | A63B 53/0466 473/342 |
| 2016/0201165 | A1 | 7/2016 | Foltz, IV | |

FOREIGN PATENT DOCUMENTS

| | | | |
|---|---|---|---|
| EP | 2526215 | A2 | 11/2012 |
| EP | 2596143 | A1 | 5/2013 |
| EP | 2848708 | A1 | 3/2015 |
| EP | 3245308 | A1 | 11/2017 |
| EP | 2526215 | B1 | 2/2019 |
| RU | 2058418 | C1 | 4/1996 |
| RU | 2595079 | C1 | 8/2016 |
| WO | 2012174501 | A1 | 12/2012 |
| WO | 2014093009 | A1 | 6/2014 |

OTHER PUBLICATIONS

Search Report for Patent Appl. No. GB2003495.5 mail date Sep. 11, 2020, 6 pages.

International Search Report and Written Opinion for PCT Appl. No. PCT/GB2021/050608 mail date May 18, 2021, 9 pages.

Combined Search and Examination Report for Patent Appl. No. GB2103367.5 mail date Aug. 23, 2021, 7 pages.

Examination Report for Patent Appl. No. GB2103367.5 mail date Jun. 6, 2022, 3 pages.

International Preliminary Report on Patentability for PCT Appl. No. PCT/GB2021/050608 mail date Sep. 22, 2022, 6 pages.

* cited by examiner

Fig. 5

| | | | | | | | | | | | | | |
|---|---|---|---|---|---|---|---|---|---|---|---|---|---|
| | Cross sectional area of starting stock, $in^2$ | | | | 36 | | | | | | | | |
| | | | | | | | | | | | | | |
| Current Process | Position | 1 | 2 | 3 | 4 | 5 | 6 | 7 | 8 | 9 | 10 | 11 | 12 |
| True Strain (TS) % in pre-form | $H_{01}$ | 139 | 108 | 75 | 94 | 58 | 32 | 17 | 17 | 17 | 17 | 17 | 17 |
| | $H_{02}$ | 0 | 0 | 0 | 0 | 0 | 0 | 0 | 77 | 14 | 58 | 130 | 58 |
| | | | | | | | | | | | | | |
| New Process | Position | 1 | 2 | 3 | 4 | 5 | 6 | 7 | 8 | 9 | 10 | 11 | 12 |
| True Strain ($T_S$) % in pre-form | $H_{N1}$ | 75 | 75 | 75 | 75 | 58 | 32 | 17 | 17 | 17 | 17 | 17 | 17 |
| | $H_{N2}$ | 64 | 33 | 0 | 19 | 0 | 0 | 0 | 0 | 0 | 0 | 0 | 0 |
| | $H_{N3}$ | 0 | 0 | 0 | 0 | 0 | 0 | 0 | 14 | 14 | 58 | 58 | 58 |
| | $H_{N4}$ | 0 | 0 | 0 | 0 | 0 | 0 | 0 | 62 | 0 | 0 | 72 | 0 |
| | | | | | | | | | | | | | |
| | Max $T_{SO}$ | 139 | | Reduction in $T_S$ | | 46.04% | | | | | | | |
| | Max $T_{SN}$ | 75 | | | | | | | | | | | |

METHOD OF FORMING PRECURSOR INTO A Ti ALLOY ARTICLE

FIELD OF THE INVENTION

The present invention relates to thermomechanical forming of α+β Ti alloys. This invention was made with US Government support awarded by the US Department of Defense. The US Government has certain rights in the invention.

RELATED APPLICATIONS

This application is a national phase application filed under 35 USC § 371 of PCT Application No. PCT/GB2021/050608 with an International filing date of Mar. 11, 2021, which claims priority of GB Patent Application 2003495.5 filed Mar. 11, 2020 and EP patent application No. 20275056.8 filed Mar. 11, 2020. Each of these applications is herein incorporated by reference, in its entirety, for all purposes.

BACKGROUND

Manufacturing of components, for example aerospace components, from α+β Ti alloys typically includes:

1. thermomechanical forming, for example forging, rolling, extruding or drawing, of precursors, for example forging, rolling, extruding or drawing stock, at a temperature of at most the beta transus temperature $\beta_{transus}$ of the α+β Ti alloys, thereby providing articles thermomechanically formed from the precursors;
2. optionally heat treatment, for example β annealing and/or stabilisation annealing of the articles; and
3. machining of the articles, thereby providing the components from the articles.

A problem arises in that such manufacturing may result in the prior β grain size in the components (i.e. the machined articles) being relatively coarse, for example greater than 0.20" (5.1 mm), thereby adversely affecting mechanical properties of the components, especially fatigue crack growth and to an extent fracture toughness, tensile strength and/or ductility of the components and/or stress corrosion resistance of the components. Components exhibiting such a relatively coarse prior β grain size are non-compliant, according to manufacturing specifications, and since remediation is not practical and/or possible, such components must be disposed, thereby reducing the yield. Particularly, such relatively coarse prior β grain size may be exhibited in only a relatively small proportion of components, for example 3% to 20% by number of the components, similarly manufactured from similar precursors. Furthermore, characterisation of the prior β grain size may usually only be performed after machining of the articles, for example by non-destructive testing of the components, since such relatively coarse prior β grains are typically found more proximal to central portions of the articles and thus only revealed upon machining of the articles. However, at such an end stage of manufacturing, a time and/or a cost of manufacturing the non-compliant components has already been invested.

Hence, there is a need to improve manufacturing of components, for example aerospace components, from α+β Ti alloys.

SUMMARY OF THE INVENTION

It is one aim of the present invention, amongst others, to provide a method of thermomechanically forming an article, a method of manufacturing a component and/or such an article and/or such a component which at least partially obviates or mitigates at least some of the disadvantages of the prior art, whether identified herein or elsewhere. For instance, it is an aim of embodiments of the invention to provide a method of thermomechanically forming an article from an α+β Ti alloy having a relatively finer prior β grain size. For instance, it is an aim of embodiments of the invention to provide a method of manufacturing a component having a higher yield. For instance, it is an aim of embodiments of the invention to provide an article and/or a component having a relatively finer prior β grain size.

A first aspect provides a method of thermomechanically forming, for example forging, rolling, extruding or drawing, an article from a precursor thereof, the method comprising:

providing the precursor, for example an ingot, a forging stock, a forging, a bar, a billet or a plate, comprising, substantially comprising, essentially comprising and/or consisting of an α+β Ti alloy having a beta transus temperature $\beta_{transus}$, wherein the precursor defines a set of portions including a first portion; and thermomechanically forming the article from the precursor by heating the first portion and deforming the heated first portion by a total true strain $\varepsilon_{1,total}$, wherein the total true strain $\varepsilon_{1,total}$ is greater than a predetermined threshold true strain $\varepsilon_{threshold}$;

wherein thermomechanically forming the article from the precursor comprises i iterations of:

(a) heating the first portion to a temperature $T_i$ during a time $t_i$, wherein the temperature $T_i$ is at most the beta transus temperature $\beta_{transus}$; transus;

(b) deforming the heated first portion by a true strain $\varepsilon_{1,i}$, wherein the true strain $\varepsilon_{1,i}$ is at most the predetermined threshold true strain $\varepsilon_{threshold}$; and (c) repeating steps (a) and (b) until the cumulative true strain $\varepsilon_{1,cumulative}=\Sigma_i\varepsilon_{1,i}$ is the total true strain $\varepsilon_{1,total}$, wherein i is a natural number greater than or equal to 2;

wherein the temperature $T_i$ is in a range from $\beta_{transus}$—97° C. to $\beta_{transus}$—3° C.;

wherein the time $t_i$ is in a range from 0.5 hours to 12 hours wherein i is equal to 1;

wherein the time $t_i$ is in a range from 0.25 hours to 4 hours wherein i is greater than or equal to 2; and wherein the predetermined threshold true strain $\varepsilon_{threshold}$ is in a range from 0.5 to 0.85.

A second aspect provides a method of manufacturing a component, for example an aerospace component such as a spar or a longeron, comprising:

thermomechanically forming an article according to the first aspect; and machining, for example milling, turning, boring or drilling, the first portion of the article, thereby providing, at least in part, the component.

A third aspect provides an article thermomechanically formed according to the first aspect or a component manufactured according to the second aspect, wherein a maximum prior β grain size of the α+β Ti alloy in the first portion is in a range from 10 μm to 25 mm, preferably in a range from 100 μm to 13 mm, more preferably in a range from 0.3 mm to 2.5 mm.

According to the present invention there is provided a method of thermomechanically forming an article, as set forth in the appended claims. Also provided is a method of manufacturing a component from such an article, such an article and such a component. Other features of the invention will be apparent from the dependent claims, and the description that follows.

Method of Thermomechanically Forming an Article

A first aspect provides a method of thermomechanically forming, for example forging, rolling, extruding or drawing, an article from a precursor thereof, the method comprising:

providing the precursor, for example an ingot, a forging stock, a forging, a bar, a billet or a plate, comprising, substantially comprising, essentially comprising and/or consisting of an α+β Ti alloy having a beta transus temperature $\beta_{transus}$, wherein the precursor defines a set of portions including a first portion; and thermomechanically forming the article from the precursor by heating the first portion and deforming the heated first portion by a total true strain $\varepsilon_{1,total}$, wherein the total true strain $\varepsilon_{1,total}$ is greater than a predetermined threshold true strain $\varepsilon_{threshold}$;

wherein thermomechanically forming the article from the precursor comprises i iterations of:

(a) heating the first portion to a temperature $T_i$ during a time $t_i$, wherein the temperature $T_i$ is at most the beta transus temperature $\beta_{transus}$;

(b) deforming the heated first portion by a true strain $\varepsilon_{1,i}$, wherein the true strain $\varepsilon_{1,i}$ is at most the predetermined threshold true strain $\varepsilon_{threshold}$; and (c) repeating steps (a) and (b) until the cumulative true strain $\varepsilon_{1,cumulative}=\Sigma_i\varepsilon_{1,i}$ is the total true strain $\varepsilon_{1,total}$, wherein i is a natural number greater than or equal to 2;

wherein the temperature $T_i$ is in a range from $\beta_{transus}$—97° C. to $\beta_{transus}$—3° C.;

wherein the time $t_i$ is in a range from 0.5 hours to 12 hours wherein i is equal to 1;

wherein the time $t_i$ is in a range from 0.25 hours to 4 hours wherein i is greater than or equal to 2; and wherein the predetermined threshold true strain $\varepsilon_{threshold}$ is in a range from 0.5 to 0.85.

Particularly, the inventors have identified that portions of the precursor, such as the first portion, that are deformed by a total true strain $\varepsilon_{1,total}$ greater than the predetermined threshold true strain $\varepsilon_{threshold}$ are susceptible to exhibiting a relatively coarse prior β grain size in the thermomechanically formed article. Hence, by limiting the true strain $\varepsilon_{1,i}$ of the heated first portion during each deforming step (b) to at most the predetermined threshold true strain $\varepsilon_{threshold}$, such a relatively coarse prior β grain size is avoided, thereby improving mechanical properties of the of the article and/or a component machined therefrom, especially fatigue crack growth and to an extent fracture toughness, tensile strength and/or ductility of the article and/or a component machined therefrom and/or stress corrosion resistance of the article and/or a component machined therefrom. In order to thermomechanically form the article, the heating step (a) and the deforming step (b) are repeated, as necessary, until the heated first portion is deformed by the total true strain $\varepsilon_{1,total}$. In other words, the precursor is repeatedly heated and deformed until the desired shape or form of the article is achieved, while restricting the amount of deforming during each repetition to at most the predetermined threshold true strain $\varepsilon_{threshold}$.

The method is of thermomechanically forming, for example forging, rolling, extruding or drawing, the article from the precursor thereof. Generally, thermomechanical forming, is a metallurgical process that combines mechanical or plastic deformation processes, such forging, rolling, extruding or drawing, with thermal processes, such as heat treating, quenching, heating and cooling at various rates, into a single process. In one example, the thermomechanical forming comprises and/or is forging of the article from the precursor thereof.

Forging of α+β Ti alloys is known. As with other forging alloys, the mechanical properties of α+β Ti alloys are affected by forging and thermal processes as well as alloy content. However, when die filling is optimized, there is only a moderate change in tensile properties with grain direction, and comparable strengths and ductilities are obtainable in both thick and thin sections. α+β Ti alloys are more difficult to forge than most steels, for example. The metallurgical behaviour of the α+β Ti alloys imposes some limitations and controls on forging operations and influences the steps in the manufacturing operation. Special care is generally exercised throughout all processing steps to minimize surface contamination by oxygen, carbon or nitrogen. These contaminants can severely impair ductility, fracture toughness, and the overall quality of a titanium forging if left on the surfaces. Hydrogen can also be absorbed by titanium alloys and can cause problems if levels exceed specified amounts. Hydrogen absorption, unlike that of oxygen, is not always confined to the surface. Titanium alloys can be forged to precision tolerances. However, excessive die wear, the need for expensive tooling, and problems with microstructure control and contamination may make the cost of close tolerance (not machined) forging prohibitive except for simple shapes like compressor fan blades for turbo-fan engines. Close tolerance forgings in moderately large sizes are currently being developed using hot die and isothermal forging techniques.

In one example, the article comprises and/or is a semi-finished intermediate (also known as a preform), for subsequent machining. Typically, such a semi-finished intermediate is subject to subsequent thermomechanical processing, for example block and finish forging (also known as blocking or blocker die and finish forging), thereby providing a machining blank. Alternatively, the semi-finished intermediate comprises and/or is a machining blank, suitable for subsequent rough and/or finish machining.

The method comprises providing the precursor, for example an ingot, a forging stock, a forging, a bar, a billet or a plate. In one example, the precursor comprises and/or is a forging stock such as a round, square or rectangular bar or a billet, for example, such as having cross-sectional dimensions (i.e. width and height and/or diameter) in a range from 50 mm×50 mm to 500 mm×500 mm, preferably in a range from 100 mm×100 mm to 300 mm×300 mm, for example 200 mm×200 mm and/or a length in a range from 50 mm to 5,000 mm, preferably in a range from 500 mm to 2,000 mm. Other sizes are known.

The precursor comprises, substantially comprises, essentially comprises and/or consists of the α+β Ti alloy having a beta transus temperature $\beta_{transus}$. α+β Ti alloys are described below in detail. In one example, the α+β Ti alloy comprises and/or is according to Grade 5. In one example, the α+β Ti alloy comprises and/or is according to Table 1. In one example, the α+β Ti alloy comprises and/or is AMS 4928 (AMS 4928, AMS 4928 Rev. A-W or later), AMS 4930 (AMS 4930, AMS 4930 Rev. A-K or later), AMS 4965 (AMS 4965, AMS 4965 Rev. A-M or later), AMS 4967 (AMS 4967, AMS 4967 Rev. A-M or later), AMS 6932 (AMS 6932, AMS 6932 Rev. A-C or later), LMA-M5004 (LMA-M5004, LMA-M5004 Rev. A-F or later) and/or an equivalent and/or a variant thereof. In one preferred example, the α+β Ti alloy comprises and/or is AMS 6932 (AMS 6932, AMS 6932 Rev. A-C or later), LMA-M5004

(LMA-M5004, LMA-M5004 Rev. A-F or later) and/or an equivalent and/or a variant thereof.

The precursor defines the set of portions including the first portion. It should be understood that the set of portions comprises and/or is a logical partitioning or divisions of the precursor and thus each portion is a respective volume of the precursor. It should be understood that the respective portions of the set of portions may have the same or different shapes, sizes and/or volumes. Hence, the set of portions corresponds with finite elements as used in finite element methods. It should be understood that the respective portions of the set proportions may be deformed during the thermal mechanical forming by the same or different true strains. In other words, different portions may be subjected to different deformations, for example by forging, so as to provide the desired shape of the article. In one example, the set of portions includes N portions, where N is a natural number greater than or equal to 1, for example 1, 10, 100, 1,000, 10,000, 100,000, 1,000,000 or more. For example, a regularly-shaped, simple precursor such as a square cross-sectional billet (i.e. a forging stock) may be forged into an irregularly-shaped, complex article, such that different portions are subjected to different deformations, for example in which the different portions are subjected to different total true strains $\varepsilon_{N,total}$ spanning a factor of 10, 100 or more. In contrast, a regularly-shaped, simple precursor such as a rectangular cross-sectional billet (i.e. a rolling stock) may be rolled into an regularly-shaped, simple article, such that different portions are subjected to similar or the same deformations, for example in which the different portions are subjected to similar or the same total true strains $\varepsilon_{N,\ total}$ spanning a factor of 5, 2 or less. Extrusion and/or drawing may be more analogous to rolling than forging, in this respect.

The method comprises thermomechanically forming the article from the precursor by heating the first portion and deforming the heated first portion by the total true strain $\varepsilon_{1,total}$, wherein the total true strain $\varepsilon_{1,total}$ is greater than the predetermined threshold true strain $\varepsilon_{threshold}$. In other words, the first portion is hot worked by the total true strain $\varepsilon_{1,total}$, which exceeds the predetermined threshold true strain $\varepsilon_{threshold}$. That is, the predetermined threshold true strain $\varepsilon_{threshold}$ is the limit beyond which relatively coarse prior β grain sizes may be exhibited in the article.

Generally, true strain ε (also called natural strain) may be defined by:

$$\varepsilon = \ln\left(\frac{D_f}{D_i}\right)$$

where $D_i$ is an initial dimension, for example an initial cross-sectional area of the first portion i.e. in the precursor, and $D_f$ is a corresponding final dimension, for example a final cross-sectional area of the first portion i.e. in the article.

The true strain ε is related to engineering strain $\varepsilon_{eng}$ by $$\varepsilon = \ln(1 + \varepsilon_{eng})$$

where $$\varepsilon_{eng} = \frac{D_f - D_i}{D_i}.$$

Thermomechanically forming the article from the precursor comprises i iterations of:

(a) heating the first portion to the temperature $T_i$ during the time $t_i$, wherein the temperature $T_i$ is at most the beta transus temperature $\beta_{transus}$;

(b) deforming the heated first portion by the true strain $\varepsilon_{1,i}$, wherein the true strain $\varepsilon_{1,i}$ is at most the predetermined threshold true strain $\varepsilon_{threshold}$; and (c) repeating steps (a) and (b) until the cumulative true strain $\varepsilon_{1,cumulative}=\Sigma_i\varepsilon_{1,i}$ is the total true strain $\varepsilon_{1,total}$, wherein i is the natural number greater than or equal to 2.

That is, the heating step (a) and the deforming step (b) are repeated, as necessary, until the heated first portion is deformed by the total true strain $\varepsilon_{1,total}$. In other words, the precursor is repeatedly heated and deformed until the desired shape of the article is formed, while restricting the amount of deforming during each repetition to at most the predetermined threshold true strain $\varepsilon_{threshold}$. In this way, a relatively coarse prior β grain size is avoided, thereby improving mechanical properties of the components, especially fatigue crack growth and to an extent fracture toughness, tensile strength and/or ductility of the components and/or stress corrosion resistance of the components.

It should be understood that repeating steps (a) and (b) (i.e. when i is greater than or equal to 2) comprise reheating the first portion to the temperature $T_i$ during the time $t_i$, wherein the temperature $T_i$ is at most the beta transus temperature $\beta_{transus}$, and further deforming the heated first portion by the true strain $\varepsilon_{1,i}$, wherein the true strain $\varepsilon_{1,i}$ is at most the predetermined threshold true strain $\varepsilon_{threshold}$, respectively. It should understood that the precursor and the first portion are thus repeatedly heated and deformed by repeating steps (a) and (b), such that a shape of the precursor and the first portion is iteratively deformed. For convenience, the intermediate during these repeated steps is referred to as the precursor, until the final shape of the article is formed.

More generally, thermomechanically forming the article from the precursor comprises i iterations of:

(a) heating the precursor, defining the set of portions including N portions wherein N is a natural number greater than or equal to 1, to the temperature $T_i$ during the time $t_i$, wherein the temperature $T_i$ is at most the beta transus temperature $\beta_{transus}$;

(b) deforming respective portions of the set of portions of the heated precursor, by respective true strains $\varepsilon_{N,i}$, wherein the true strain $\varepsilon_{N,i}$ of each portion is at most the predetermined threshold true strain $\varepsilon_{threshold}$; and (c) repeating steps (a) and (b) until the cumulative true strain $\varepsilon_{N,cumulative}=\Sigma_i\varepsilon_{N,i}$ is the total true strain $\varepsilon_{N,total}$, wherein i is a natural number greater than or equal to 2.

It should be understood that the first portion is heated to the temperature $T_i$ during (i.e. for) the time $t_i$, thereby heating the first portion to a temperature suitable for the deformation, for example forging, rolling, extruding or drawing. Generally, deforming is an adiabatic process, such that the precursor heats during the deforming, notwithstanding that cooling occurs due to heat losses to the environment and/or the deforming apparatus, such as a forging press. In one example, the deforming is isothermal, for example isothermal forging.

In one example, the temperature $T_i$ is in a range from $\beta_{transus}$—175° F. (97° C.) to $\beta_{transus}$—5° F. (3° C.), preferably in a range from $\beta_{transus}$—150° F. (83° C.) to $\beta_{transus}$—15° F. (8° C.), more preferably in a range from $\beta_{transus}$—

125° F. (69° C.) to $\beta_{transus}$—25° F. (14° C.). That is, the precursor is deformed below the beta transus temperature $\beta_{transus}$, in the α+β phase. If the temperature $T_i$ is too high, the heated first portion may be further heated above the beta transus temperature $\beta_{transus}$ during the deforming, due to adiabatic heating thereof. Conversely, if the temperature $T_i$ is too low, deforming of the heated first portion may be problematic and/or more difficult.

In one example, the time $t_i$ is in a range from 0.25 hours to 24 hours, preferably in a range from 0.5 hours to 12 hours, more preferably in a range from 1 hour to 8 hours, most preferably in a range from 2 hours to 6 hours wherein i is equal to 1.

In one example, the time $t_i$ is in a range from 0.25 hours to 4 hours, preferably in a range from 0.5 hours to 2 hours, more preferably in a range from 0.75 hours to 1.5 hours, for example 1 hour, wherein i is greater than or equal to 2.

That is, the precursor may be initially hot soaked, before the first iteration (i.e. wherein i is equal to 1) of the deforming step (b) for generally a longer time than subsequent reheats (i.e. wherein i is greater than 1) between repeated deforming steps (b).

It should be understood that the heated first portion is deformed, for example forged, rolled, extruded or drawn, by the true strain $\varepsilon_{1,i}$, wherein the true strain $\varepsilon_{1,i}$ is at most the predetermined threshold true strain $\varepsilon_{threshold}$;

In one example, the predetermined threshold true strain $\varepsilon_{threshold}$ is in a range from 0.1 to 1, preferably in a range from 0.3 to 0.9, more preferably in a range from 0.5 to 0.85 for example 0.61 to 0.85, 0.61 to 0.825, 0.65 to 0.85, 0.65 to 0.825, 0.675 to 0.85 or 0.675 to 0.825, most preferably in a range from 0.7 to 0.8, for example 0.725 to 0.775, about 0.75 or 0.75. In this way, a relatively coarse prior β grain size is avoided, thereby improving mechanical properties of the components, especially fatigue crack growth and to an extent fracture toughness, tensile strength and/or ductility of the article and/or a component machined therefrom and/or stress corrosion resistance of the article and/or a component machined therefrom.

In one example, deforming the heated first portion by the total true strain $\varepsilon_{1,total}$ comprises elongating the heated first portion by a total elongation $(\delta L/L)_{total}$, wherein the total elongation $(\delta L/L)_{total}$ is at least a predetermined threshold elongation $(\delta L/L)_{threshold}$. That is, a length L of the heated first portion may be increased by a minimum increase in length δL. For example, the precursor may be elongated during forging, for example.

In one example, the predetermined threshold elongation $(\delta L/L)_{threshold}$ is in a range from 0.1 to 10, preferably in a range from 0.25 to 5, more preferably in a range from 0.5 to 2.5, most preferably in a range from 0.75 to 1.25, for example 1. That is, the length L of the heated first portion may be increased by a minimum increase in length δL=L, when $(\delta L/L)_{threshold}=1$, for example.

In one example, i is in a range from 2 to 10, for example 2, 3, 4, 5, 6, 7, 8, 9 or 10, preferably in a range from 2 to 5, for example 2, 3, 4 or 5. Generally, it is desirable to minimise i while the true strain $\varepsilon_{1,i}$, is at most the predetermined threshold true strain $\varepsilon_{threshold}$ In this way, a number of repetitions of the (a) and (b) is reduced, thereby controlling cost and/or complexity.

In one example, providing the precursor comprises providing the precursor having a cross-sectional aspect ratio in a range from 1:2 to 2:1, preferably in a range from 2:3 to 3:2, more preferably in a range from 3:4 to 4:3, for example about 1:1, wherein the cross-sectional aspect ratio is the ratio of a mutually-orthogonal cross-sectional dimensions, and/or providing the precursor having a longitudinal aspect ratio in a range from 1,000:1 to 1:1, preferably in a range from 100:1 to 4:3, more preferably in a range from 50:1 to 3:2, for example at least 2:1. In other words, the precursor may be a length of forging stock such as a round, square or rectangular bar or a billet, for example, such as having cross-sectional dimensions (i.e. width and height and/or diameter) in a range from 50 mm×50 mm to 500 mm×500 mm, preferably in a range from 100 mm×100 mm to 300 mm×300 mm, for example 200 mm×200 mm and/or a length in a range from 50 mm to 5,000 mm, preferably in a range from 500 mm to 2,000 mm. Other sizes are known.

In one example, the method comprises thermomechanical processing of the thermomechanically formed article, for example block and finish forging of the thermomechanically formed article, such as before beta annealing.

In one example, the method comprises β annealing the article at a temperature $T_{\beta\ anneal}$ during a time $t_{\beta\ anneal}$, wherein the temperature $T_{\beta\ anneal}$ is at least the beta transus temperature $\beta_{transus}$. It should be understood that the β annealing is subsequent to step (c) (i.e. after repeating steps (a) and (b) until the cumulative true strain $\varepsilon_{1,cumulative}=\Sigma_i\varepsilon_{1,i}$ is the total true strain $\varepsilon_{1,total}$, wherein i is the natural number greater than or equal to 2). β annealing is known. That is, the β annealing is of the thermomechanically formed article.

In one example, the method comprises stabilization annealing the article at a temperature $T_{stabilization\ anneal}$ during a time $t_{stabilization\ anneal}$, wherein the temperature $T_{stabilization\ anneal}$ is less than the beta transus temperature $\beta_{transus}$. It should be understood that the β annealing is subsequent to step (c) (i.e. after repeating steps (a) and (b) until the cumulative true strain $\varepsilon_{1,cumulative}=\Sigma_i\varepsilon_{1,i}$ is the total true strain $\varepsilon_{1,total}$, wherein i is the natural number greater than or equal to 2). Stabilization annealing is known. That is, the stabilization annealing is of the thermomechanically formed article. In one example, stabilization annealing the article comprises stabilization annealing the β annealed article (i.e. after β annealing the thermomechanically formed article).

In one example, providing the precursor comprises vacuum arc melting, plasma arc melting and/or electron beam melting and/or vacuum arc re-melting the α+β Ti alloy. In this way, a solute content and/or microstructure of the precursor may be improved. In one example, providing the precursor comprises vacuum arc remelting the α+β Ti alloy, for example subsequent to vacuum arc melting, plasma arc melting and/or electron beam melting the α+β Ti alloy. That is, the α+β Ti alloy may be melted twice.

In one example, a maximum grain size of the prior β phase of the α+β Ti alloy in the first portion of the article is in a range from 10 μm to 25 mm, preferably in a range from 100 μm to 13 mm, more preferably in a range from 0.3 mm to 2.5 mm. In this way, a relatively coarse prior β grain size is avoided, thereby improving mechanical properties of the article, especially fatigue crack growth and to an extent fracture toughness, tensile strength and/or ductility of the article and/or stress corrosion resistance of the article. The prior 13 grain size in the α+β Ti alloy may be determined by image analysis of polished or machined and etched surfaces, according to known metallographic techniques, of the article, for example using Beuhler OmniMet® or Clemex Vision PE® microstructural image analysis software. Additionally and/or alternatively, the prior β grain size in the α+β Ti alloy may be determined from visual inspection and direct measurement (i.e. using a ruler and/or a gauge), for example of the etched surface.

In one example, a microstructure of the α+β Ti alloy in the first portion of the article, for example after beta annealing, comprises, substantially comprises, essentially comprises or consists of a fully transformed microstructure, for example having little (at most 5%, preferably at most 2%, more preferable at most 0.5% by volume fraction) or no (at most 0.1% by volume fraction) primary or equiaxed α phase.

In one preferred example, the method is of thermomechanically forming by forging the article from the precursor thereof, the method comprising:

providing the precursor, wherein the precursor is a forging stock such as a round, square or rectangular bar or a billet, having cross-sectional dimensions in a range from 50 mm×50 mm to 500 mm×500 mm, preferably in a range from 100 mm×100 mm to 300 mm×300 mm, for example 200 mm×200 mm and/or a length in a range from 50 mm to 5,000 mm, preferably in a range from 500 mm to 2,000 mm, consisting of the α+β Ti alloy having a beta transus temperature $\beta_{transus}$, wherein the precursor defines the set of portions including a first portion; and thermomechanically forming the article from the precursor by heating the first portion and deforming the heated first portion by the total true strain $\varepsilon_{1,total}$, wherein the total true strain $\varepsilon_{1,total}$ is greater than the predetermined threshold true strain $\varepsilon_{threshold}$;

wherein thermomechanically forming the article from the precursor comprises i iterations of:

(a) heating the first portion to the temperature $T_i$ during the time $t_i$, wherein the temperature $T_i$ is at most the beta transus temperature $\beta_{transus}$;

(b) deforming the heated first portion by a true strain $\varepsilon_{1,i}$, wherein the true strain $\varepsilon_{1,i}$ is at most the predetermined threshold true strain $\varepsilon_{threshold}$;

(c) repeating steps (a) and (b) until the cumulative true strain $\varepsilon_{1,cumulative}=\Sigma_i\varepsilon_{1,i}$ is the total true strain $\varepsilon_{1,total}$, wherein i is the natural number greater than or equal to 2;

thermomechanical processing the article, for example block and finish forging of the article;

β annealing the article at a temperature $T_{\beta\ anneal}$ during a time $t_{\beta\ anneal}$, wherein the temperature $T_{\beta\ anneal}$ is at least the beta transus temperature $\beta_{transus}$; and stabilization annealing the (β annealed) article at a temperature $T_{stabilization\ anneal}$ during a time $t_{stabilization\ anneal}$, wherein the temperature $T_{stabilization\ anneal}$ is less than the beta transus temperature $\beta_{transus}$;

wherein the α+β Ti alloy comprises and/or is AMS 6932 (AMS 6932, AMS 6932 Rev. A-C or later), LMA-M5004 (LMA-M5004, LMA-M5004 Rev. A-F or later) and/or an equivalent and/or a variant thereof;

wherein the predetermined threshold true strain $\varepsilon_{threshold}$ is in a range from 0.1 to 1, preferably in a range from 0.3 to 0.9, more preferably in a range from 0.5 to 0.85, most preferably in a range from 0.7 to 0.8, for example 0.75;

wherein deforming the heated first portion by the total true strain $\varepsilon_{1,total}$ comprises elongating the heated first portion by a total elongation $(\delta L/L)_{total}$, wherein the total elongation $(\delta L/L)_{total}$ is at least a predetermined threshold elongation $(\delta L/L)_{threshold}$;

wherein the predetermined threshold elongation $(\delta L/L)_{threshold}$ is in a range from 0.1 to 10, preferably in a range from 0.25 to 5, more preferably in a range from 0.5 to 2.5, most preferably in a range from 0.75 to 1.25, for example 1;

wherein providing the precursor comprises providing the precursor having a cross-sectional aspect ratio in a range from 1:2 to 2:1, preferably in a range from 2:3 to 3:2, more preferably in a range from 3:4 to 4:3, for example about 1:1, wherein the cross-sectional aspect ratio is the ratio of a mutually-orthogonal cross-sectional dimensions, and/or providing the precursor having a longitudinal aspect ratio in a range from 1,000:1 to 1:1, preferably in a range from 100:1 to 4:3, more preferably in a range from 50:1 to 3:2, for example at least 2:1;

wherein the temperature $T_i$ is in a range from $\beta_{transus}$—175° F. (97° C.) to $\beta_{transus}$—5° F. (3° C.) preferably in a range from $\beta_{transus}$—150° F. (83° C.) to $\beta_{transus}$—15° F. (8° C.) more preferably in a range from $\beta_{transus}$—125° F. (69° C.) to $\beta_{transus}$—25° F. (14° C.);

wherein the time $t_i$ is in a range from 0.25 hours to 24 hours, preferably in a range from 0.5 hours to 12 hours, more preferably in a range from 1 hour to 8 hours, most preferably in a range from 2 hours to 6 hours wherein i is equal to 1;

wherein the time $t_i$ is in a range from 0.25 hours to 4 hours, preferably in a range from 0.5 hours to 2 hours, more preferably in a range from 0.75 hours to 1.5 hours, for example 1 hour, wherein i is greater than or equal to 2;

wherein a microstructure of the α+β Ti alloy in the first portion of the article, for example after beta annealing, comprises, substantially comprises, essentially comprises or consists of a fully transformed microstructure, for example having little (at most 5%, preferably at most 2%, more preferable at most 0.5% by volume fraction) or no (at most 0.1% by volume fraction) primary or equiaxed α phase; and wherein a maximum prior β grain size in the α+β Ti alloy in the first portion of the article is in a range from 10 μm to 25 mm, preferably in a range from 100 μm to 13 mm, more preferably in a range from 0.3 mm to 2.5 mm.

α+β Ti Alloys

Elements having an atomic radius within ±15% of the atomic radius of Ti are substitutional elements and have significant solubility in Ti. Elements having an atomic radius less than 59% of the atomic radius of Ti, for example H, N, O and C, occupy interstitial sites and also have substantial solubility. The relatively high solubilities of substitutional and interstitial elements in Ti makes it difficult to design precipitation-hardened Ti alloys. However, B has a similar but larger radius than C, O, N and H and it is therefore possible to induce titanium boride precipitation. Cu precipitation is also possible in some alloys.

The substitutional elements may be categorised according to their effects on the stabilities of the α and β phases. Hence, Al, O, N and Ga are α stabilisers while Mo, V, W and Ta are all β stabilisers. Cu, Mn, Fe, Ni, Co and H are also β stabilisers but form the eutectoid. The eutectoid reaction is frequently sluggish (since substitutional atoms involved) and is suppressed. Mo and V have the largest influence on β stability and are common alloying elements. W is rarely added due to its high density. Cu forms TiCu2, which makes such Ti alloys age-hardening and heat treatable. Zr, Sn and Si are neutral elements.

The interstitial elements do not fit properly in the Ti lattices and cause changes in the lattice parameters. Hydrogen is the most important interstitial element. Body-centred cubic (BCC) Ti has three octahedral interstices per atom while closed-packed hexagonal (CPH) Ti has one octahedral interstice per atom. The latter are therefore larger, so that the solubility of O, N, and C is much higher in the a phase.

Most α+β Ti alloys (also known as α–β Ti alloys, alpha-beta titanium alloys, dual-phase titanium alloys or two-phase titanium alloys) have high-strength and formability, and contain 4-6 wt. % of β stabilisers which allow substantial amounts of β to be retained on quenching from the β→α+β phase fields. A typical α+β Ti alloy is Ti-6Al-4V (all nominal compositions in wt. % unless noted otherwise), while other α+β Ti alloys include Ti-6Al-6V-2Sn and Ti-6Al-2Sn-4Zr-Mo. Al reduces alloy density, stabilises and strengthens the α phase and increases the α+β→β transformation temperature while V provides a greater amount of the more ductile β phase for hot-working and reduces the α+β→β transformation temperature. Table 1 shows nominal compositions of selected α+β Ti alloys.

ability, heat treatability and weldability. Depending on required mechanical properties, heat treatments applied to Ti-6Al-4V alloys and more generally to α+β Ti alloys include: partial annealing (600-650° C. for about 1 hour), full annealing (700-850° C. followed by furnace cooling to about 600° C. followed by air cooling) or solutioning (880-950° C. followed by water quenching) and ageing (400-600° C.).

α+β Ti alloys constitute a very important group of structural materials used in aerospace applications. The microstructures of these α+β Ti alloys can be varied significantly during thermomechanical processing and/or heat treatment, allowing for tailoring of their mechanical properties, including fatigue behaviour, to specific application requirements.

TABLE 1

Nominal compositions of selected α + β Ti alloys.

| α + β Ti alloys designation | Tensile strength (MPa, min) | 0.2% yield strength (MPa, min) | Composition (wt. %) | | | | | | | | | Impurity limits (wt. %, max) | | | | |
|---|---|---|---|---|---|---|---|---|---|---|---|---|---|---|---|---|
| | | | Al | Sn | Zr | Mo | V | Cu | Mn | Cr | Si | N | C | H | Fe | O |
| Ti-6Al-4V (a) (g) (i) AMS 4928W | 900 | 830 | 5.5-6.75 | | | | 3.5-4.5 | | | | | 0.05 | 0.08 | 0.0125 | 0.30 | 0.20 |
| Ti-6Al-4V ELI (g) (h) AMS 4930K | 830 | 760 | 5.5-6.5 | | | | 3.5-4.5 | | | | | 0.05 | 0.08 | 0.0125 | 0.25 | 0.13 |
| Ti-6Al-4V (g) (i) AMS 4965K | 890 | 820 | 5.5-6.75 | | | | 3.5-4.5 | | | | | 0.05 | 0.08 | 0.0125 | 0.30 | 0.20 |
| Ti-6Al-4V (a) (g) (i) AMS 4967M | 890 | 820 | 5.5-6.75 | | | | 3.5-4.5 | | | | | 0.05 | 0.08 | 0.0125 | 0.30 | 0.20 |
| Ti-6Al-4V ELI (g) (h) (j) AMS 6932C | 860 | 790 | 5.5-6.5 | | | | 3.5-4.5 | | | | | 0.05 | 0.08 | 0.0125 | 0.25 | 0.13 |
| Ti-6Al-4V (g) (h) (i) AMS 4905F | 860 | 790 | 5.6-6.3 | | | | 3.6-4.4 | | | | | 0.03 | 0.05 | 0.0125 | 0.25 | 0.12 |
| Ti-6Al-6V-2Sn (a) (g) (i) AMS 4971L | 1030 | 970 | 5.0-6.0 | 1.5-2.5 | | | 5.0-6.0 | 0.35-1.0 | | | | 0.04 | 0.05 | 0.015 | | 0.2 |
| Ti-6Al-4V (g) (h) TIMETAL 6-4 ASTM Grade 5 Mil T-9047 | 970 | 920 | 5.5-6.75 | | | | 3.5-4.5 | | | | | 0.05 | 0.08 | 0.015 | 0.40 | 0.2 |
| Ti-6Al-4V (g) (h) TIMETAL 6-4 ELI ASTM Grade 23 AMS 4981 | 970 | 920 | 5.5-6.5 | | | | 3.5-4.5 | | | | | 0.03 | 0.08 | 0.0125 | 0.25 | 0.13 |
| Ti-6Al-4V-0.1Ru (g) (h) (k) ASTM Grade 29 | 970 | 920 | 5.5-6.5 | | | | 3.5-4.5 | | | | | 0.03 | 0.08 | 0.015 | 0.25 | 0.13 |
| Ti-8Mn (a) | 860 | 760 | | | | | | | 8 | | | 0.05 | 0.08 | 0.015 | 0.5 | 0.2 |
| Ti-7Al-4Mo (a) | 1030 | 970 | 7 | | | 4 | | | | | | 0.05 | 0.1 | 0.013 | 0.3 | 0.2 |
| Ti-6Al-2Sn-4Zr-6Mo (b) AMS 4981 | 1170 | 1100 | 6 | 2 | 4 | 6 | | | | | | 0.04 | 0.04 | 0.0125 | 0.15 | 0.15 |
| Ti-5Al-2Sn-2Zr-4Mo-4Cr (b)(c) | 1125 | 1055 | 5 | 2 | 2 | 4 | | | | 4 | | 0.04 | 0.05 | 0.0125 | 0.3 | 0.13 |
| Ti-6Al-2Sn-2Zr-2Mo-2Cr (c) | 1030 | 970 | 5.7 | 2 | 2 | 2 | | | | 2 | 0.25 | 0.03 | 0.05 | 0.0125 | 0.25 | 0.14 |
| Ti-3Al-2.5V(d) | 620 | 520 | 3 | | | | 2.5 | | | | | 0.015 | 0.05 | 0.015 | 0.3 | 0.12 |
| Ti-4Al-4Mo-2Sn-0.5Si | 1100 | 960 | 4 | 2 | | 4 | | | | | 0.5 | (e) | 0.02 | 0.0125 | 0.2 | (e) |

(a) Mechanical properties given for the annealed condition; may be solution treated and aged to increase strength;
(b) Mechanical properties given for the solution-treated-and-aged condition; alloy not normally applied in annealed condition;
(c) Semicommercial alloy; mechanical properties and composition limits subject to negotiation with suppliers;
(d) Primarily a tubing alloy; may be cold drawn to increase strength;
(e) Combined O2 + 2N2 = 0.27%;
(f) Also solution treated and aged using an alternative aging temperature (480° C., or 900° F.);
(g) other elements total (wt. %, max) 0.40;
(h) other elements each (wt. %, max) 0.10;
(i) Y (wt. %, max) 0.005;
(j) Y (wt. %, max) 0.05;
(k) Ru (wt. %, min) 0.08, Ru (wt. %, max) 0.14

Ti-6Al-4V (martensitic α+β Ti alloy; $K_\beta$=0.3) accounts for about half of all the titanium alloys produced and is popular because of its strength (1100 MPa), creep resistance at 300° C., fatigue resistance, good castability, plastic work- The main types of microstructure of α+β Ti alloys are:

1. lamellar, formed after slow cooling when deformation or heat treatment takes place at a temperature in the single-phase field above the beta transus temperature $\beta_{transus}$, comprising colonies of HCP α phase lamellae within large BCC β phase grains of several hundred microns in diameter; and 2. equiaxed, formed after deformation in the two-phase α+β field (i.e. below the beta transus temperature $\beta_{transus}$), comprising globular α-phase dispersed in a β phase matrix.

The beta transus temperature $\beta_{transus}$ is the temperature at which the α+β→β transformation takes place and is thus the lowest temperature at which the Ti alloy is composed of a volume fraction $V_f$=1 of the BCC β phase.

The lamellar microstructure is characterized by relatively low tensile ductility, moderate fatigue properties, and good creep and crack growth resistance. Important parameters of the lamellar microstructure with respect to mechanical properties include the β grain size D, size d of the colonies of α phase lamellae, thickness t of the α phase lamellae and the morphology of the interlamellar interface (β phase). Generally, an increase in cooling rate leads to refinement of the microstructure—both α phase colony size d and α phase lamellae thickness t are reduced. Additionally, new α phase colonies tend to nucleate not only on β phase boundaries but also on boundaries of other α phase colonies, growing perpendicularly to the existing α phase lamellae. This leads to formation of a characteristic microstructure called "basket weave" or Widmanstätten microstructure.

The equiaxed microstructure has a better balance of strength and ductility at room temperature and fatigue properties which depend noticeably on the crystallographic texture of the HCP α phase.

An advantageous balance of properties can be obtained by development of bimodal microstructure consisting of primary α grains and fine lamellar α colonies within relatively small β grains (10-20 μm in diameter).

The phase composition of α+β Ti alloys after cooling from the β phase is controlled, at least in part, by the cooling rate. The kinetics of phase transformations is related, at least in part, to the β phase stability coefficient $K_\beta$ due to the chemical composition of the α+β Ti alloy. The range of the α+β→β phase transformation temperature determines, at least in part, conditions of thermomechanical processing intended for development of a desired microstructure. Start and finish temperatures of α+β→β phase transformation vary depending, at least in part, on the amounts of β stabilizing elements (Table 2).

TABLE 2

Start and finish temperature of the α + β → β phase transformation for selected α + β Ti alloys ($v_h = v_c$ = 0.08° C. s−1); ns: nucleation start; ps: precipitation start; s: start; f: finish.

| Temperature (° C.) | Ti-6Al-4V | Ti-6Al-2Mo-2Cr | Ti-6Al-5Mo-5V-1Cr-1Fe |
|---|---|---|---|
| $T_{\alpha+\beta\to\beta}^{ns}$ | 890 | 840 | 790 |
| $T_{\alpha+\beta\to\beta}^{ps}$ | 930 | 920 | 830 |
| $T_{\alpha+\beta\to\beta}^{f}$ | 985 | 980 | 880 |
| $T_{\beta\to\alpha+\beta}^{s}$ | 950 | 940 | 850 |
| $T_{\beta\to\alpha+\beta}^{s}$ | 870 | 850 | 810 |

The microstructure of α+β Ti alloys after deformation or heat treatment carried out above the beta transus temperature $\beta_{transus}$ depends, at least in part, on the cooling rate. Relatively higher cooling rates (>18° C. s−1) result in martensitic α' (α") microstructure for alloys having β phase stability coefficient $K_\beta$<1 and metastable $\beta_M$ microstructure for alloys having higher β phase stability coefficient $K_\beta$. Low and moderate cooling rates lead to development of lamellar microstructures consisting of colonies of α phase lamellae within large β phase grains. A decrease in cooling rate cause an increase in both the thickness t of individual α phase lamellae and size d of the α colonies. These in turn lower the yield stress and tensile strength of these α+β Ti alloys.

The lamellar α phase microstructure of α+β Ti alloys heat treated in the β phase has a beneficial effect on fatigue behaviour, due to frequent changes in crack direction and secondary crack branching. When α phase lamellae are too large, thin layers of β phase are not capable of absorbing large amounts of energy and retard crack propagation. In this case, the α phase colonies behave as singular element of the microstructure. This phenomenon is more pronounced in α+β Ti alloys having smaller β phase stability coefficients $K_\beta$, such as Ti-6Al-4V. A sufficient thickness of the β phase enables absorption of energy in the process of plastic deformation of regions ahead of crack tips, contributing to slowing a rate of crack propagation and therefore increasing fatigue life.

Method of Manufacturing a Component

The second aspect provides a method of manufacturing a component, for example an aerospace component such as a spar or a longeron, comprising:

thermomechanically forming an article according to the first aspect; and machining, for example milling, turning, boring or drilling, the first portion of the article, thereby providing, at least in part, the component.

In this way, the component is provided, at least in part, by machining the article. Since the article is formed by thermomechanically forming in which the true strain $\varepsilon_{1,i}$, of the heated first portion is limited during each deforming step (b) to at most the predetermined threshold true strain $\varepsilon_{threshold}$, a relatively coarse prior β grain size is avoided, thereby improving mechanical properties of the article and/or the component machined therefrom, especially fatigue crack growth and to an extent fracture toughness, tensile strength and/or ductility of the article and/or the component machined therefrom and/or stress corrosion resistance of the article and/or the component machined therefrom.

In one example, the method comprises non-destructive testing of the component. In one example, non-destructive testing of the component comprises non-destructive testing of the machined component. In one example, non-destructive testing of the component comprises determination of a maximum prior β grain size in the α+β Ti alloy, for example as determined by image analysis of polished or machined and etched surfaces, according to known metallographic techniques, of the article, for example using Beuhler OmniMet® or Clemex Vision PE® microstructural image analysis software.

In one example, machining comprises removing an amount of the first portion in a range from 10% to 99.5%, preferably in a range from 25% to 99%, more preferably in a range from 50% to 97.5% by volume of the first portion. In other words, a substantial amount (at least 10%) or even a major amount (at least 50%) of the article is removed during machining.

Article and Component

The third aspect provides an article thermomechanically formed according to the first aspect or a component manufactured according to the second aspect, wherein a maximum prior β grain size in the α+β Ti alloy in the first portion of the article or the component is in a range from 10 μm to 25 mm, preferably in a range from 100 μm to 13 mm, more preferably in a range from 0.3 mm to 2.5 mm.

The maximum grain size may be as described with respect to the first aspect.

Definitions

Throughout this specification, the term "comprising" or "comprises" means including the component(s) specified but not to the exclusion of the presence of other components. The term "consisting essentially of" or "consists essentially of" means including the components specified but excluding other components except for materials present as impurities, unavoidable materials present as a result of processes used to provide the components, and components added for a purpose other than achieving the technical effect of the invention, such as colourants, and the like.

The term "consisting of" or "consists of" means including the components specified but excluding other components.

Whenever appropriate, depending upon the context, the use of the term "comprises" or "comprising" may also be taken to include the meaning "consists essentially of" or "consisting essentially of", and also may also be taken to include the meaning "consists of" or "consisting of".

The optional features set out herein may be used either individually or in combination with each other where appropriate and particularly in the combinations as set out in the accompanying claims. The optional features for each aspect or exemplary embodiment of the invention, as set out herein are also applicable to all other aspects or exemplary embodiments of the invention, where appropriate. In other words, the skilled person reading this specification should consider the optional features for each aspect or exemplary embodiment of the invention as interchangeable and combinable between different aspects and exemplary embodiments.

BRIEF DESCRIPTION OF THE DRAWINGS

For a better understanding of the invention, and to show how exemplary embodiments of the same may be brought into effect, reference will be made, by way of example only, to the accompanying diagrammatic Figures, in which:

FIG. 5 schematically depicts an exemplary method of thermomechanically forming the article of FIG. 4.

DETAILED DESCRIPTION

Figure 1:
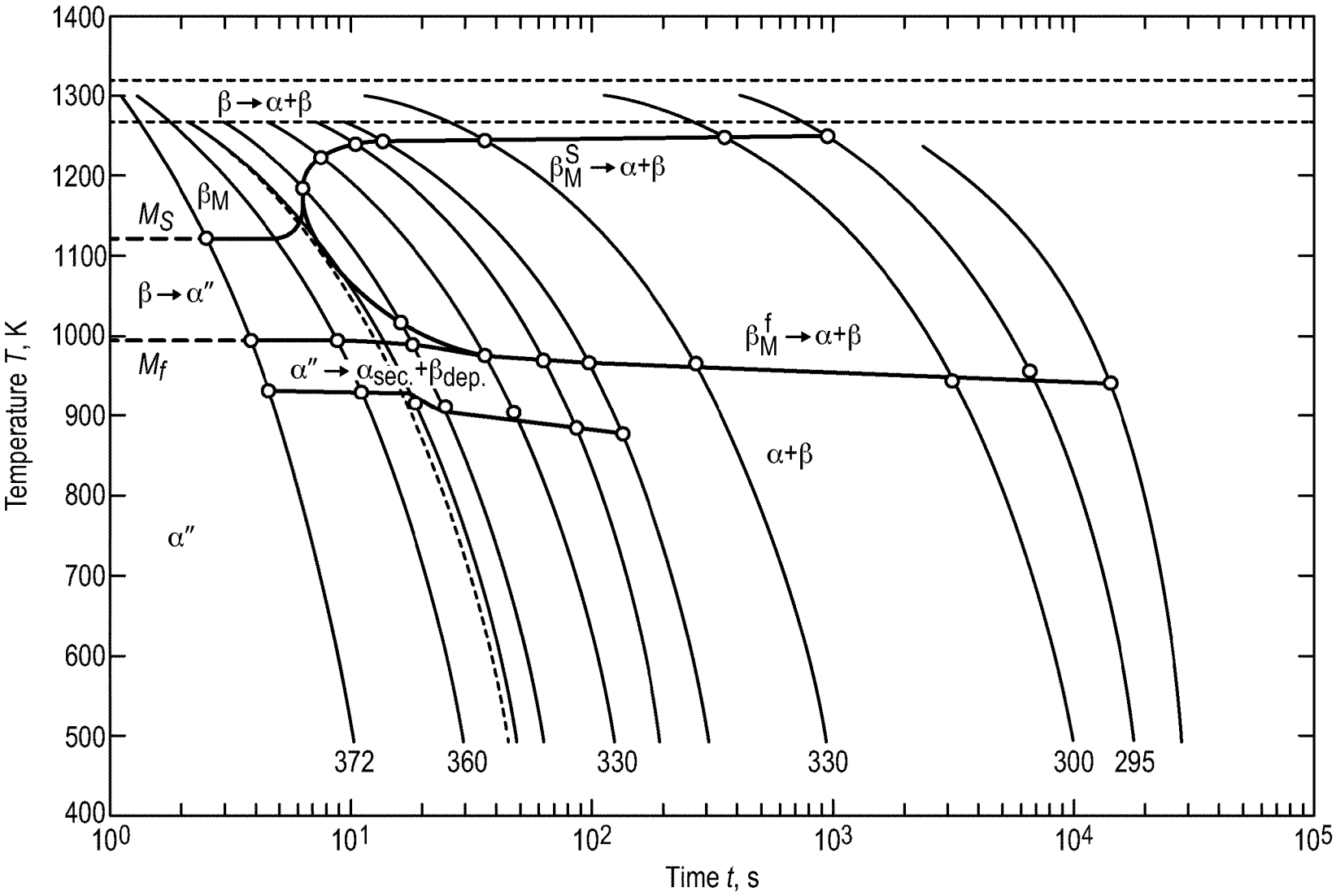
FIG. 1 schematically depicts a continuous cooling transformation (CCT) curve for a Ti-6Al-4V α+β Ti alloy.
Figure 2:
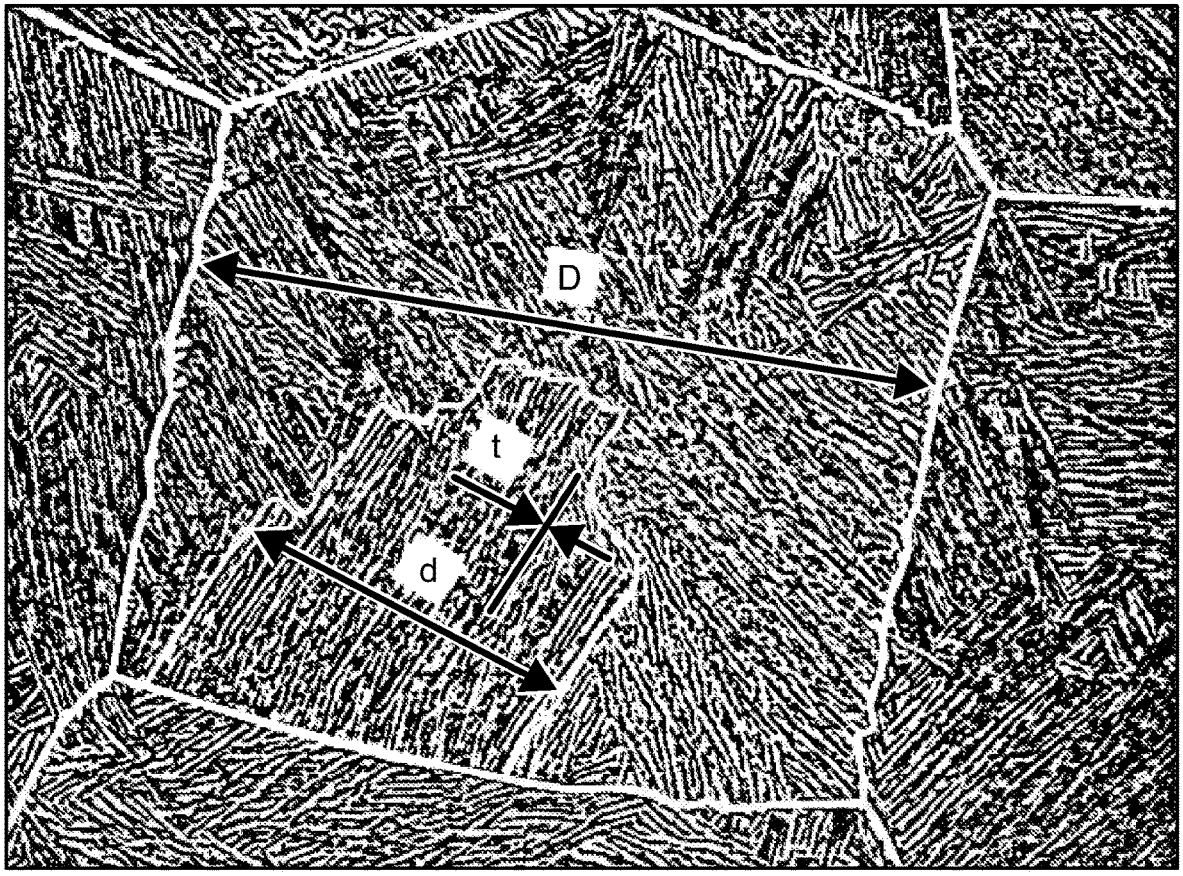
FIG. 2 shows an optical micrography of a lamellar microstructure of a Ti-6Al-4V α+β Ti alloy.
Figure 3:
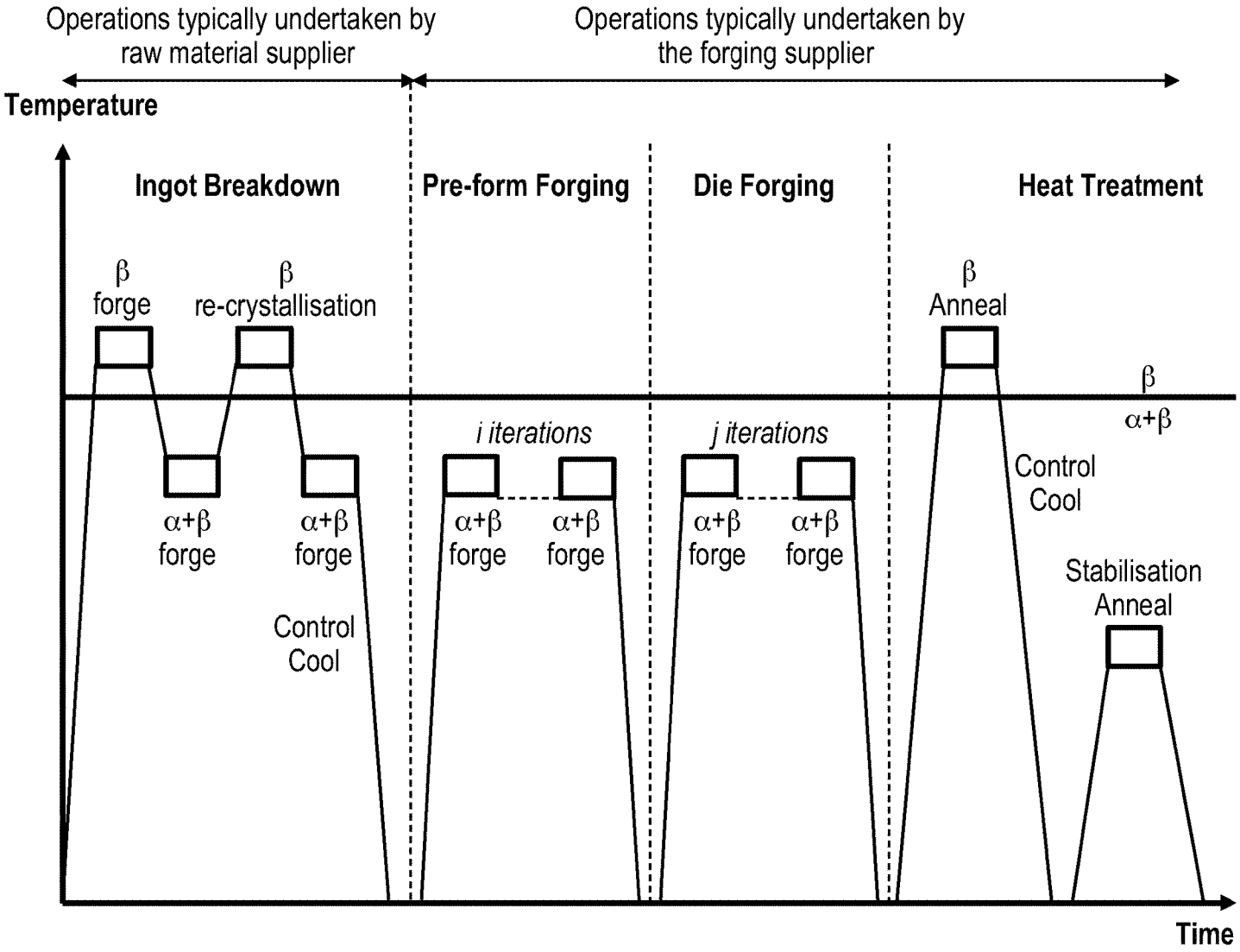
FIG. 3 schematically depicts a method of thermomechanically forming an α+β Ti alloy.

FIG. 3 schematically depicts a method of thermomechanically forming an α+β Ti alloy. It should be understood that the exemplary method of thermomechanically forming, for example forging, rolling, extruding or drawing, an article from a precursor thereof relates to at least the step of pre-form forging and optionally, to the steps of die forging and/or subsequent heat treatment.

Figure 4:
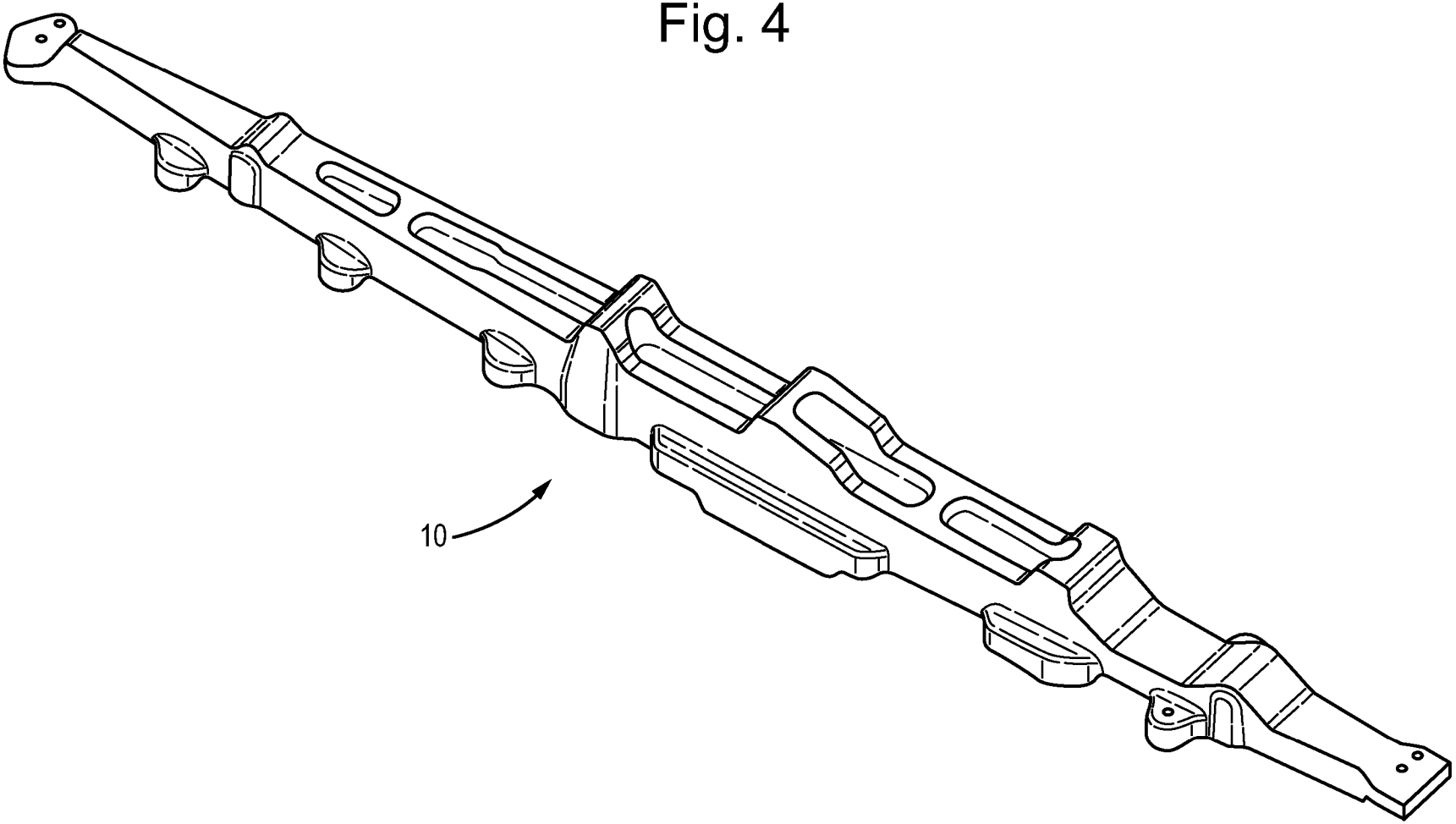
FIG. 4 is a CAD drawing of an article according to an exemplary embodiment.

FIG. 4 is a CAD drawing of an article 10, particularly for machining into a rib for an aircraft (i.e. an aerospace component), according to an exemplary embodiment.

The article 10 was thermomechanically formed according to an exemplary embodiment, as described with respect to FIG. 5, from a precursor 1 wherein the precursor 1 is a forging stock particularly a square bar, having a width of 6" (152 mm), a height of 6" (152 mm) and a length of 47" (1194 mm). The article 10 has a length of about 96" (2438 mm).

FIG. 5 schematically depicts an exemplary method of thermomechanically forming the article 10 of FIG. 4.

In more detail, FIG. 5 compares a conventional method of thermomechanically forming a conventional article (labelled 'Current Process') and the exemplary method of thermomechanically forming the exemplary article 10 (labelled 'New Process').

The conventional method comprises:

providing a precursor, consisting of the α+β Ti alloy having a beta transus temperature $\beta_{transus}$, wherein the precursor defines the set of 12 portions (labelled 'Position 1 to 12') including a first portion (labelled 'Position 1'); and thermomechanically forming the article from the precursor by heating the first portion and deforming the heated first portion by the total true strain $\varepsilon_{1,total}$=1.39;

wherein thermomechanically forming the article from the precursor comprises 2 iterations of:

(a) heating the first portion to the temperature $T_i$ during the time $t_i$, wherein the temperature $T_i$ is at most the beta transus temperature $\beta_{transus}$;

(b) deforming the heated first portion 100A by a true strain $\varepsilon_{1,i}$, wherein the true strain $\varepsilon_{1,i}$, is the total true strain $\varepsilon_{1,total}$=1.39;

β annealing the thermomechanically formed article 10 at a temperature $T_{\beta\ anneal}$ during a time $t_{\beta\ anneal}$, wherein the temperature $T_{B\ anneal}$ is at least the beta transus temperature $\beta_{transus}$; and stabilization annealing the (β annealed) article 10 at a temperature $T_{stabilization\ anneal}$ during a time $t_{stabilization\ anneal}$, wherein the temperature $T_{stabilization\ anneal}$ is less than the beta transus temperature $\beta_{transus}$;

wherein the α+β Ti alloy comprises and/or is AMS 6932 (AMS 6932, AMS 6932 Rev. A-C or later), LMA-M5004 (LMA-M5004, LMA-M5004 Rev. A-F or later) and/or an equivalent and/or a variant thereof;

wherein deforming the heated first portion 100A by the total true strain $\varepsilon_{1,total}$ comprises elongating the heated first portion 100A by a total elongation $(\delta L/L)_{total}$, wherein the total elongation $(\delta L/L)_{total\ is}$ at least a predetermined threshold elongation $(\delta L/L)_{threshold}$;

wherein the predetermined threshold elongation $(\delta L/L)_{threshold}$ is about 1"(25.4 mm);

wherein providing the precursor 1 comprises providing the precursor 1 having a cross-sectional aspect ratio of 1:1, wherein the cross-sectional aspect ratio is the ratio of a mutually-orthogonal cross-sectional dimensions, and providing the precursor 1 having a longitudinal aspect ratio of about 8:1;

wherein the temperature $T_i$ is in a range from $\beta_{transus}$—125° F. (69° C.) to $\beta_{transus}$—25° F. (1.4° C.);

wherein the time $t_i$ is about 3 hours wherein i is equal to 1.

In this particular example according to the conventional method, the precursor is a forging stock particularly a square bar, having a width of 6" (152 mm), a height of 6" (152 mm) and a length of 47" (1194 mm), while the length of the article is about 96" (2438 mm).

In the conventional method, 'Positions 1 to 12' are deformed during the 1st iteration (i.e. wherein i is equal to 1) while only 'Positions 8 to 12' are deformed during the 2nd iteration (i.e. wherein i is equal to 2).

In the 1st iteration (i.e. wherein i is equal to 1), the heated first portion 'Position 1' is deformed by a true strain $\varepsilon_{1,1}$=1.39 and the heated eleventh portion 'Position 11' is deformed by a true strain $\varepsilon_{11,1}$=0.17, by way of example.

In the 2nd iteration (i.e. wherein i is equal to 2), the heated first portion 'Position 1' is deformed by a true strain $\varepsilon_{1,2}$=0 and the heated eleventh portion 'Position 11' is deformed by a true strain $\varepsilon_{1,2}$=1.30.

The exemplary method is of thermomechanically forming by forging the article 10 from the precursor 1 (not shown) thereof, the method comprising:

providing the precursor 1, consisting of the α+β Ti alloy having a beta transus temperature $\beta_{transus}$, wherein the precursor 1 defines the set of 12 portions 100 (labelled 'Position 1 to 12') including a first portion 100A (labelled 'Position 1'); and thermomechanically forming the article 10 from the precursor 1 by heating the first portion 100A and deforming the heated first portion 100A by the total true strain $\varepsilon_{1,total}$, wherein the total true strain $\varepsilon_{1,total}$ is greater than the predetermined threshold true strain $\varepsilon_{threshold}$;

wherein thermomechanically forming the article 10 from the precursor 1 comprises 2 iterations of:

(a) heating the first portion 100A to the temperature $T_i$ during the time $t_i$, wherein the temperature $T_i$ is at most the beta transus temperature $\beta_{transus}$;

(b) deforming the heated first portion 100A by a true strain $\varepsilon_{1,i}$, wherein the true strain $\varepsilon_{1,i}$, is at most the predetermined threshold true strain $\varepsilon_{threshold}$;

(c) repeating steps (a) and (b) until the cumulative true strain $\varepsilon_{1,cumulative}=\Sigma_i\varepsilon_{1,i}$ is the total true strain $\varepsilon_{1,total}$, wherein i is 4;

thermomechanical processing the thermomechanically formed article 10, for example block and finish forging of the thermomechanically formed article 10;

β annealing the thermomechanically formed article 10 at a temperature $T_{\beta\ anneal}$ during a time $t_{\beta\ anneal}$, wherein the temperature $T_{\beta\ anneal}$ is at least the beta transus temperature $\beta_{transus}$; and stabilization annealing the (β annealed) article 10 at a temperature $T_{stabilization\ anneal}$ during a time $t_{stabilization\ anneal}$, wherein the temperature $T_{stabilization\ anneal}$ is less than the beta transus temperature $\beta_{transus}$;

wherein the α+β Ti alloy comprises and/or is AMS 6932 (AMS 6932, AMS 6932 Rev. A-C or later), LMA-M5004 (LMA-M5004, LMA-M5004 Rev. A-F or later) and/or an equivalent and/or a variant thereof;

wherein the predetermined threshold true strain $\varepsilon_{threshold}$ is 0.75 (i.e. 75%);

wherein deforming the heated first portion 100A by the total true strain $\varepsilon_{1,total}$ comprises elongating the heated first portion 100A by a total elongation $(\delta L/L)_{total}$, wherein the total elongation $(\delta L/L)_{total}$ is at least a predetermined threshold elongation $(\delta L/L)_{threshold}$;

wherein the predetermined threshold elongation $(\delta L/L)_{threshold}$ is about 1" (25.4 mm);

wherein providing the precursor 1 comprises providing the precursor 1 having a cross-sectional aspect ratio of 1:1, wherein the cross-sectional aspect ratio is the ratio of a mutually-orthogonal cross-sectional dimensions, and providing the precursor 1 having a longitudinal aspect ratio of about 8:1;

wherein the temperature $T_i$ is in a range from $\beta_{transus}$—125° F. (69° C.) to $\beta_{transus}$—25° F. (14° C.);

wherein the time $t_i$ is about 3 hours wherein i is equal to 1;

wherein the time $t_i$ is about 1 hour, wherein i is greater than or equal to 2; and wherein a maximum prior β grain size of the α+β Ti alloy in the first portion 100A of the article 10 is in a range from 10 μm to 25 mm, preferably in a range from 100 μm to 13 mm, more preferably in a range from 0.3 mm to 2.5 mm.

In this particular example according to the exemplary method, the precursor 1 is a forging stock particularly a square bar, having a width of 6" (152 mm), a height of 6" (152 mm) and a length of 47" (1194 mm), while the length of the article 10 is about 96" (2438 mm).

In the exemplary method, 'Positions 1 to 12' are deformed during the 1st iteration (i.e. wherein i is equal to 1), 'Positions 1, 2 and 4' are deformed during the 2nd iteration (i.e. wherein i is equal to 2), 'Positions 8 to 12' are deformed during the 3rd iteration (i.e. wherein i is equal to 3) and 'Positions 8 and 11' are deformed during the 4th iteration (i.e. wherein i is equal to 4).

Particularly, in the 1st iteration (i.e. wherein i is equal to 1), the heated first portion 100A (Position 1) is deformed by a true strain $\varepsilon_{1,1}$=0.75, wherein the true strain $\varepsilon_{1,1}$ is at most the predetermined threshold true strain $\varepsilon_{threshold}$, and the heated eleventh portion 100K (Position 11') is deformed by a true strain $\varepsilon_{11,1}$=0.17, wherein the true strain $\varepsilon_{11,1}$ is at most the predetermined threshold true strain $\varepsilon_{threshold}$, wherein the predetermined threshold true strain $\varepsilon_{threshold}$ is 0.75 (i.e. 75%).

Particularly, in the 2nd iteration (i.e. wherein i is equal to 2), the heated first portion 100A (Position 1') is deformed by a true strain $\varepsilon_{1,2}$=0.64, wherein the true strain $\varepsilon_{1,2}$ is at most the predetermined threshold true strain $\varepsilon_{threshold}$, and the heated eleventh portion 100K (Position 11') is deformed by a true strain $\varepsilon_{11,2}$=0, wherein the true strain $\varepsilon_{11,2}$ is at most the predetermined threshold true strain $\varepsilon_{threshold}$, wherein the predetermined threshold true strain $\varepsilon_{threshold}$ is 0.75 (i.e. 75%).

Particularly, in the 3rd iteration (i.e. wherein i is equal to 3), the heated first portion 100A (Position 1') is deformed by a true strain $\varepsilon_{1,3}$=0, wherein the true strain $\varepsilon_{1,3}$ is at most the predetermined threshold true strain $\varepsilon_{threshold}$, and the heated eleventh portion 100K (Position 11') is deformed by a true strain $\varepsilon_{11,3}$=0.58, wherein the true strain $\varepsilon_{11,3}$ is at most the predetermined threshold true strain $\varepsilon_{threshold}$, wherein the predetermined threshold true strain $\varepsilon_{threshold}$ is 0.75 (i.e. 75%).

Particularly, in the 4th iteration (i.e. wherein i is equal to 4), the heated first portion 100A (Position 1') is deformed by a true strain $\varepsilon_{1,4}$=0, wherein the true strain $\varepsilon_{1,4}$ is at most the predetermined threshold true strain $\varepsilon_{threshold}$, and the heated eleventh portion 100K (Position 11') is deformed by a true strain $\varepsilon_{11,4}$=0.72, wherein the true strain $\varepsilon_{11,4}$ is at most the predetermined threshold true strain $\varepsilon_{threshold}$, wherein the predetermined threshold true strain $\varepsilon_{threshold}$ is 0.75 (i.e. 75%).

That is, compared with the conventional method, the number of heating steps has been increased from 2 to 4 while the respective portions are deformed by at most the predetermined threshold true strain $\varepsilon_{threshold}$ of 0.75 (i.e. 75%).

While the yield for the conventional process was about 80%, due to disposal of components having relatively coarse prior β grain size, the yield for the exemplary process was improved to approaching 100%.

Although a preferred embodiment has been shown and described, it will be appreciated by those skilled in the art that various changes and modifications might be made without departing from the scope of the invention, as defined in the appended claims and as described above.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims and drawings), and/or all of the steps of any method or process so disclosed, may be combined in any combination, except combinations where at most some of such features and/or steps are mutually exclusive.

Each feature disclosed in this specification (including any accompanying claims, and drawings) may be replaced by alternative features serving the same, is equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims and drawings), or to any novel one, or any novel combination, of the steps of any method or process so disclosed.

The invention claimed is:

1. A method of thermomechanically forming, an article from a precursor thereof, the method comprising:

providing the precursor, comprising an α+β Ti alloy having a beta transus temperature $\beta_{transus}$, wherein the precursor comprising at least a first portion; and thermomechanically forming the article from the precursor by heating the first portion and deforming the heated first portion by a total true strain $\varepsilon_{1,total}$, wherein the total true strain $\varepsilon_{1,total}$ is greater than a predetermined threshold true strain $\varepsilon_{threshold}$, wherein thermomechanically forming the article from the precursor comprises i iterations of:

(a) heating the first portion to a temperature $T_i$ during a time $t_i$, wherein the temperature $T_i$ is at most the beta transus temperature $\beta_{transus}$;

(b) deforming the heated first portion by a true strain $\varepsilon_{1,i}$, wherein the true strain $\varepsilon_{1,i}$ is at most the predetermined threshold true strain $\varepsilon_{threshold}$, and (c) repeating steps (a) and (b) until the cumulative true strain $\varepsilon_{1,cumulative}=\Sigma_i\varepsilon_{1,i}$ is the total true strain $\varepsilon_{1,total}$, wherein i is a natural number greater than or equal to 2, wherein the time $t_i$ is in a range from 0.5 hours to 12 hours when i is equal to 1, wherein the time $t_i$ is in a range from 0.25 hours to 4 hours when i is greater than or equal to 2, and wherein the predetermined threshold true strain $\varepsilon_{threshold}$ is in a range from 0.5 to 0.85.

2. The method according to claim 1, wherein the predetermined threshold true strain $\varepsilon_{threshold}$ is in a range from 0.7 to 0.8.

3. The method according to claim 1, wherein deforming the heated first portion by the total true strain $\varepsilon_{1,total}$ comprises elongating the heated first portion by a total elongation $(\delta L/L)_{total}$, and wherein the total elongation $(\delta L/L)_{total}$ is at least a predetermined threshold elongation $(\delta L/L)_{threshold}$.

4. The method according to claim 3, wherein the predetermined threshold elongation $(\delta L/L)_{threshold}$ is in a range from 0.75 to 1.25.

5. The method according to claim 1, wherein providing the precursor comprises providing the precursor having a cross-sectional aspect ratio in a range from 3:4 to 4:3, wherein the cross-sectional aspect ratio is the ratio of a mutually-orthogonal cross-sectional dimensions, and/or providing the precursor having a longitudinal aspect ratio in a range from 50:1 to 3:2.

6. The method according to claim 1, wherein the temperature $T_i$ is in a range from $\beta_{transus}$—69° C. to $\beta_{transus}$—14° C.

7. The method according to claim 1, wherein the time $t_i$ is in a range from 2 hours to 6 hours when i is equal to 1.

8. The method according to claim 1, wherein the time $t_i$ is in a range from 0.75 hours to 1.5 hours when i is greater than or equal to 2.

9. The method according to claim 1, further comprising β annealing the article at a temperature $T_{\beta\ anneal}$ during a time $t_{\beta\ anneal}$, wherein the temperature $T_{\beta\ anneal}$ is at least the beta transus temperature $\beta_{transus}$.

10. The method according to claim 1, further comprising stabilization annealing the article at a temperature $T_{stabilization\ anneal}$ during a time $t_{stabilization\ anneal}$, wherein the temperature $T_{stabilization\ anneal}$ is less than the beta transus temperature transus.

11. The method according to claim 1, wherein providing the precursor comprises vacuum arc melting, plasma arc melting and/or electron beam melting and/or vacuum arc re-melting the α+β Ti alloy.

12. A method of manufacturing a component comprising:

thermomechanically forming an article according to claim 1; and machining the first portion of the article, thereby providing, at least in part, the component.

13. The method according to claim 12, comprising non-destructive testing of the machined component.

14. The method according to claim 12, wherein machining comprises removing an amount of the first portion in a range from 50% to 97.5% by volume of the first portion.

15. The method according to claim 1, wherein the α+β Ti alloy is AMS 6932 (AMS 6932, AMS 6932 Rev. A-C or later), LMA-M5004 (LMA-M5004, LMA-M5004 Rev. A-F or later).

16. The method according to claim 1, wherein the temperature $T_i$ is in a range from $\beta_{transus}$—97° C. to $\beta_{transus}$—3° C.

17. The method according to claim 1, wherein the precursor further comprises a second portion.

* * * * *